US006675736B1

(12) United States Patent
Schreiber et al.

(10) Patent No.: US 6,675,736 B1
(45) Date of Patent: Jan. 13, 2004

(54) BOAT HAVING CHANNELS FORMED IN ITS HULL

(75) Inventors: Roger W. Schreiber, Hubertus, WI (US); John O. Scherer, III, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/242,090

(22) Filed: Sep. 12, 2002

(51) Int. Cl.[7] ..... B63B 1/32
(52) U.S. Cl. ..... 114/290; 114/291
(58) Field of Search ..... 114/274, 291, 114/290; 440/38, 66, 69

(56) References Cited

U.S. PATENT DOCUMENTS

| | | | | |
|---|---|---|---|---|
| 3,568,617 A | | 3/1971 | Yost | 114/66 |
| 3,600,733 A | | 8/1971 | Lippisch | 9/6 |
| 4,231,314 A | * | 11/1980 | Peters | 114/291 |
| 4,392,448 A | | 7/1983 | Shirley | 114/271 |
| 4,453,489 A | * | 6/1984 | Charlins | 114/288 |
| 4,713,028 A | | 12/1987 | Duff | 440/61 |
| 4,903,626 A | | 2/1990 | Haines | 114/56 |
| 5,111,767 A | | 5/1992 | Haines | 114/288 |
| 5,205,765 A | | 4/1993 | Holden | 440/66 |
| 5,390,624 A | | 2/1995 | Barnes | 114/288 |
| 5,570,649 A | | 11/1996 | Austin | 114/61 |
| 5,570,650 A | | 11/1996 | Harley | 114/61 |
| 5,967,078 A | | 10/1999 | Eilert | 114/357 |
| 6,138,601 A | | 10/2000 | Anderson et al. | 114/285 |

OTHER PUBLICATIONS

U.S. patent application Ser. No. 09/871,098, Chrunyk, filed May 31, 2001.

* cited by examiner

*Primary Examiner*—Stephen Avila
(74) *Attorney, Agent, or Firm*—William D. Lanyi

(57) ABSTRACT

A hull of a boat, which is particularly intended for use with a jet pump propulsion system, is provided with two channels formed in the port and starboard surfaces of the hull and displaced from a keel line. Each channel comprises a forward edge that intersects the hull at an angle to define a continuous surface with a portion of the hull that is immediately forward of the channel. The channel intersects the transom of the boat at a rearward edge. Each channel has a pair of sidewalls which are contiguous with their associated generally planar surface of the channel. The sidewalls are generally parallel to a central vertical plane which extends from a bow of the boat to a transom of the boat and in which the keel line is disposed. Each pair of sidewalls are generally parallel to each other.

20 Claims, 3 Drawing Sheets

BOAT HAVING CHANNELS FORMED IN ITS HULL

BACKGROUND OF THE INVENTION

1. Field of the Invention

The present invention is generally related to a boat which has channels formed in the rearward portion of its hull and, more particularly, to a boat which is particularly shaped to facilitate the use of a propulsor in such a way that the boat is able to achieve a more optimum planning angle and also to improve the handling characteristics of the boat.

2. Description of the Prior Art

U.S. Pat. No. 3,600,733, which issued to Lippisch on Aug. 24, 1971, describes a planing boat hull. The hull is designed for maintaining a substantially constant trim angle throughout a slow to moderate speed range, with the hull having a flat-bottom central longitudinal tunnel with its side walls tapering outwardly from bow to stem to gradually increase the tunnel width, and a central lifting surface extending longitudinally throughout the tunnel, with the lifting surface being inclined to the tunnel bottom to form a channel extending forwardly of the medial portion thereof and forming an inclined plane projecting downwardly from the tunnel bottom and extending rearwardly of the medial portion.

U.S. Pat. No. 4,713,028, which issued to Duff on Dec. 15, 1987, describes a shallow water boat design. The boat provides full operation even in shallow water utilizing an outboard motor. The boat includes a main hull, a displaceable transom to which the motor is mounted and a displaceable hull section. The displaceable transom is received in sliding engagement within two guide brackets mounted to the main hull. The displaceable hull section is connected to the displaceable transom by a hinge along a rear edge. The leading edge of the displaceable hull section is received and rests within a lip in the main hull. Actuator cylinders mounted in alignment with the guide brackets raise and lower the transom and the rear end of the displaceable hull section while the leading edge of the displaceable hull section pivots and slides in the lip. When the motor is raised for shallow water operation the displaceable hull section forms a flow channel for directing water to the propeller and intake port of the motor so as to prevent damage and provide proper and efficient water cooling.

U.S. Pat. No. 5,570,649, which issued to Austin on Nov. 5, 1996, describes a boat hull structure comprising a pair of laterally spaced hulls having V-shaped bottom portions that are each symmetrical about a vertical plane extending through its longitudinal axis. A channel defined in each bottom portion that extends substantially along the length of each hull for trapping air and water to provide lift and to reduce certain disadvantageous performance is disclosed. Each channel is defined by a pair of spaced, parallel and vertical channel walls and a horizontal base that interconnects the channel walls. A pair of strikes defined on each bottom portion that straddles the channel to define a high speed planing surface is described. The strikes preferably are located at the same elevation as the base of the channel so that the boat can plane on the strikes and the base of the channel at the same time. With this construction, the planing surface area of the boat hull structure is reduced, which enhances the speed performance of the boat hull structure.

U.S. Pat. No. 5,205,765, which issued to Holden on Apr. 27, 1993, describes a boat hull and propulsion system. A device, such as a boat hull and propulsion system, is described for effecting relative movement of a flowable substance, such as water. A channel having open upstream and downstream ends at least partially defines a flow path. The channel includes a fully laterally closed core section distal the upstream end with a fluid moving rotor rotatably mounted therein and a transition section extending forward from the upstream end of the core section. The channel configuration and rotor are adapted to permit a continual decrease in the transverse cross-sectional area of the flow path downstream along the transition section. If the device is a boat hull, the bow is configured to cause gas lubrication thereof by interaction with the water in motion. The transition sections of the channels may be open bottomed and ribs are provided to house driveshafts extending downwardly to the rotors. The bow provides lift, and downwardly facing surfaces adjacent the stem are inclined to balance this lift, so that the boat can rise on the water with an upward translating type movement. The rotors themselves are also improved.

U.S. Pat. No. 5,111,767, which issued to Haines on May 12, 1992, describes a boat hull having an underside, a transom and a recess adjacent the transom extending at partially a transverse dimension or width of the underside. There is also provided a transverse step defining a transverse boundary of the recess as well as an internal hollow venting body or reservoir having at least a pair of access ports of restrictive cross sectional size compared with the enlarged cross sectional area of the venting body. The venting body is in fluid communication with the recess and the hull exterior wherein during travel of the boat hull venting of a low pressure area adjacent the recess can take place without water gaining access to the hull interior in the event of hard turning or reversing, the water being trapped in the hollow venting body or reservoir. Preferably, the venting body is elongate having a major dimension corresponding to the enlarged cross sectional area which defines a longitudinal extent of the venting body and a minor dimension defining a transverse extent of the venting body.

U.S. Pat. No. 4,903,626, which issued to Haines on Feb. 27, 1990, describes a planing motor boat hull. The hull includes a bow, a transom, a keel and an underside having a transverse step adjacent the transom which extends partially the width of the underside and a recess bounded by the transverse stop and a pair of side walls and having an open transom end. The hull underside may further include a pair of substantially planar portions wherein each portion is located adjacent to a respective side wall of the recess. The hull underside may further include a plurality of lift strakes including an outermost lift strake terminating at or adjacent the transom, one or more intermediate lift strakes terminating short of the transom and the outermost lift strake and an innermost lift strake located adjacent to the keel terminating short of the transom ends of the one or more intermediate lift strakes.

U.S. Pat. No. 4,392,448, which issued to Shirley on Jul. 12, 1983, describes a ski boat. The ski boat is intended for producing a relatively small, well-defined wake and a relatively smooth working table. It includes a V-shaped keel section. The angle of the "V" increases towards the stern of the hull. A chine panel is mounted at each of the outboard edges of the keel section. A secondary chine is locate on each side of the keel section, being parallel to the centerline of the V-shaped keel section and following the contour of the keel section. A concave depression panel is located at the stern of the boat, extending forwardly therefrom into the keel section.

U.S. Pat. No. 5,570,650, which issued to Harley on Nov. 5, 1996, describes a surface effect vessel hull. The surface effect hull is particularly suitable for use with a catamaran vessel. The twin hulls each comprise a V-shaped portion and a recess portion that receives pressurized gas therein. The V-shaped bow portion creates dynamic lift and the pressurized air portion creates an air cushion for reduction of drag.

U.S. Ser. No. 09/871,098 which was filed by Chrunyk on Dec. 20, 2001, describes a method of controlling the attitude of a boat at high speed through boat hull design and a boat hull. The method involves a first step of forming a pair of high speed steps in the hull of the boat. The pair of high speed steps provides enough surface area to control ride attitude, while reducing the wetted area of the hull to decrease drag. A second step involves forming transition steps to provide a transition to the high speed steps as the boat accelerates. In addition to reducing drag, the method aids in turning and lifting of the hull by trapping air and water in the steps.

U.S. Pat. No. 6,138,601, which issued to Anderson et al on Oct. 31, 2000, discloses a boat hull with a configurable planing surface. A V-bottom planing boat hull has right and left steps positioned so as to optimize the boat's trim angle at top speed, and defining right and left notches in which are pivotally mounted left and right trim tabs having forward leading edges and along oblique pivot axes causing outer corners of trailing edges of the trim tabs to move downwardly more than inner corners during downward pivoting of the trim tabs within an active hull to control boat trim angle and effectively reduce deadrise angle while maintaining a running surface trailing edge substantially free of discontinuities in the vertical direction.

U.S. Pat. No. 3,568,617, which issued to Yost on Mar. 9, 1971, describes a step-ramp V-hull. The boat construction is provided with longitudinally extending bottom surfaces including a forward section extending horizontally forward from generally amidships and curving forwardly and upwardly at its forward end, a generally horizontally disposed rear section spaced rearwardly of the forward section and above a horizontal plane containing the rearmost portions of the forward section, and an intermediate section inclined rearwardly and upwardly and extending between the rear and front ends of the front and rear sections, respectively, a step of low vertical height joining the front and rear ends of the intermediate and forward sections.

U.S. Pat. No. 5,967,078, which issued to Eilert on Oct. 19, 1999, discloses detachable wear strips for the hull of a watercraft. The watercraft having at least one removable protective wear strip is described. The watercraft hull includes at least one mounting groove extending along the longitudinal length of the watercraft hull along the lowermost portion of the hull. A wear strip is removably attached to each mounting groove such that when the watercraft hull is pulled from the water, the wear strips contact the shore to prevent damage to the watercraft hull. A series of attachment devices is embedded in the watercraft hull along the mounting groove. A series of connectors passes through the wear strip to removably attach the wear strip to the mounting groove contained in the watercraft hull. When the wear strip becomes worn, the wear strip can be removed from the watercraft hull and replaced with a new wear strip.

U.S. Pat. No. 5,390,624, which issued to Barnes on Feb. 21, 1995, discloses a boat with a pad bottom hull. A planing boat having a stern and is bow includes a hull having a generally flat central bottom surface forming a portion of a pad with the surface tapering from a specified width at the stem towards the bow. Reverse wedge surfaces blended with the central bottom surface at the stem and deadrise surfaces blended with the central bottom surface and intersecting with the reverse wedge surfaces continue forward towards the bow. The rear portion of the flat bottom surface is tipped upwardly towards the stem.

The patents described above are hereby expressly incorporated by reference in the description of the present invention.

As a boat with a planing hull achieves an adequate velocity, the forces on the boat reach an equilibrium condition in which the hull is planing with a minimal wetted surface. When a boat with an outboard motor or a stemdrive system accelerate from a standing position to wide open throttle (WOT), the angle and position of the propeller normally create a moment about the center of gravity of the boat which tends to raise the bow and facilitate the movement of the boat up to a planing position. However, when the boat has a pump jet propulsion system, the nozzle of the pump jet is typically positioned at a location which results in a thrust vector exerted on the boat at a position above the wetted contact surface between the hull and the water. This position of the nozzle creates a moment about the wetted surface of the boat which tends to cause the bow of the boat to move downward. This action is disadvantageous as the boat moves from a standing position to planing speed. In some applications, the use of ajet pump propulsion system in conjunction with a planing boat makes it extremely difficult to cause the boat to reach planing speed with a minimally wetted hull surface.

It would therefore be significantly beneficial if a boat hull could be provided which facilitates the boat's reaching planing speed and achieving a planing position with a minimally wetted hull surface. It would be particularly beneficial if the hull can also facilitate the handling of the boat.

SUMMARY OF THE INVENTION

A boat, made according to a preferred embodiment of the present invention, comprises a hull having a port surface and a starboard surface. The port and starboard surfaces are generally symmetrical with each other and disposed on opposite sides of a central vertical plane which extends from a bow of the boat to a transom of the boat. A first channel is formed in the port surface. The first channel has a first generally planar surface and a sidewall which is contiguous with the first generally planar surface. A forward edge of the generally planar surface intersects the hull at an angle to define a continuous surface with a first portion of the hull which is forward of the generally planar surface. A rearward edge of the planar surface intersects the transom. A second channel is formed in the starboard surface. The second surface has a second generally planar surface and a sidewall which is contiguous with the second generally planar surface. A forward edge of the second generally planar surface intersects the hull at an angle to define a continuous surface with a second portion of the hull which is forward of the second generally planar surface. A rearward edge of the planar surface intersects the transom. The sidewall which is contiguous with the first generally planar surface is generally parallel to the central vertical plane. The sidewall which is contiguous with the second generally planar surface is generally parallel to the central vertical plane.

In a particularly preferred embodiment of the present invention, the first channel has a first pair of sidewalls and the second channel has a second pair of sidewalls. A first sidewall is disposed on a port side of the first channel and a second sidewall is disposed on a starboard side of the first channel. A third sidewall is disposed on a port side of the second channel and a fourth sidewall is disposed on a starboard side of the second channel. The first pair of sidewalls are parallel to each other in a preferred embodiment of the present invention. Similarly, the second pair of side walls are also parallel to each other.

A jet pump is attached to the boat and positioned to expel water in a rearward direction to exert a thrust on the boat in a forward direction. The thrust is exerted along a line which is above at least a portion of the hull.

In a preferred embodiment of the present invention, the first and second channels are displaced from the central vertical plane. The angle is within the range of 0.5 degrees to 4.0 degrees. The width of the first channel is greater than half of the distance between the central vertical plane and a port chine of the hull. The width of the second channel is greater than half of the distance between the central vertical plane and a starboard chine of the hull. The forward edge of the first channel can be disposed between the transom and a center of gravity of the boat and the forward edge of the second channel is disposed between the transom and the center of gravity of the boat. Alternatively, the center of gravity of the boat can be disposed between the forward edge of the first channel and the transom. The center of gravity can also be disposed between the forward edge of the second channel and the transom.

In a preferred embodiment of the present invention, the first and second channels are displaced from the port chine and the starboard chine of the boat, respectively. The port and starboard surfaces intersect to form the hull in a V-shape. The port and starboard surfaces intersect along a keel line which is disposed within the central vertical plane.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
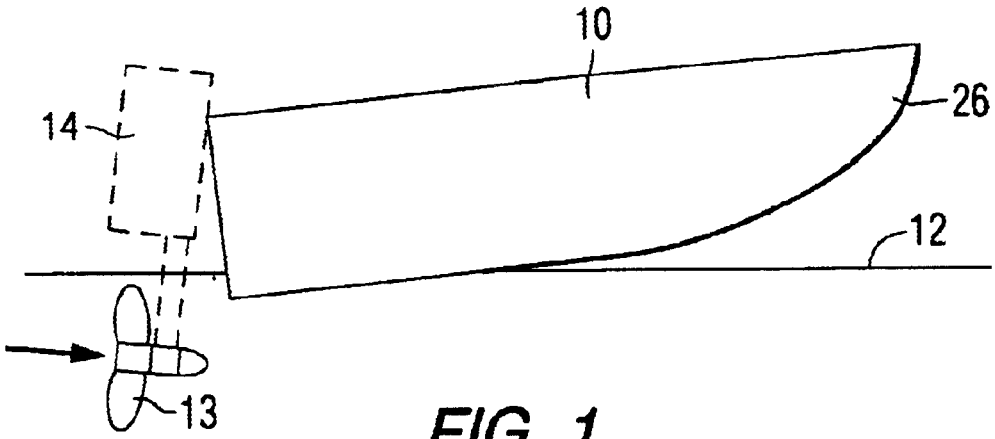
FIG. 1 is a simplified representation of a boat with an outboard motor.

Throughout the description of the preferred embodiment of the present invention, like components will be identified by like reference numerals.

Figure 2:
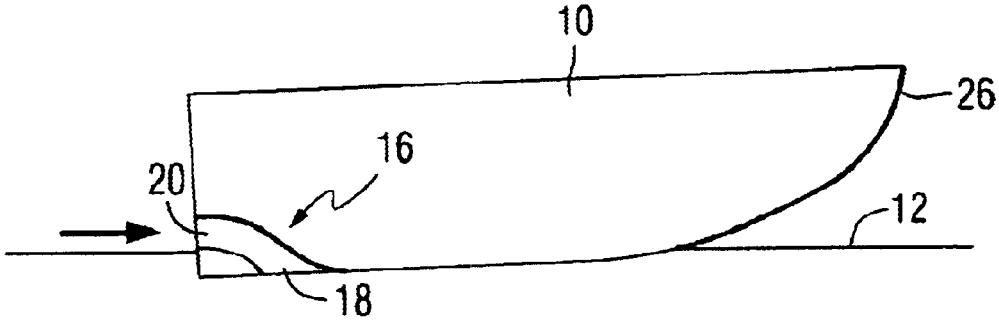
FIG. 2 is a simplified representation of a boat with a jet pump propulsion system.

FIG. 1 is a highly simplified representation of a boat 10 on a water surface 12 and being propelled by a propeller 13 of an outboard motor 14. FIG. 2 is a similar simplified diagram of a boat 10 on a surface 12 of water and being propelled by a pump jet propulsion system 16. As is well known to those skilled in the art, the pump jet propulsion system 16 typically comprises a water inlet 18 and a nozzle portion 20 from which a stream of water is expelled.

With reference to FIGS. 1 and 2, the associated thrust vector T is shown in both illustrations. As can be seen in FIG. 1, the thrust vector T provided by the propeller 13 of the outboard motor 14, or a stemdrive system, results in a moment about the hull's contact surface with the water surface 12 which tends to raise the bow 26. The moment resulting from the thrust vector T of the propeller 13 on the boat 10 is in a counterclockwise direction in FIG. 1. This is why the bow 26 tends to rise upwardly from the surface of the water 12 as a result of the propeller thrust T. A pump jet system, such as that shown in FIG. 2, often has the opposite effect. The thrust vector T caused by the flow of water expelled by the nozzle portion 20 of the pump jet system 16 is above the surface 12 of the water and therefore tends to result in a clockwise moment about the wetted surface of the hull in FIG. 2. This tends to cause the bow 26 to move downwardly toward the water surface 12 and prevent the boat 10 from easily moving up to a planing position.

With reference to FIGS. 1 and 2, it can be seen that a boat 10 which incorporates a pump jet system 16 experiences certain problems that are not inherent when an outboard motor propeller 13 is used to propel the boat 10. It would therefore be beneficial if a boat hull could be developed which ameliorates the tendency of a jet pump system 16 to cause the bow 26 to lower.

Figure 3:
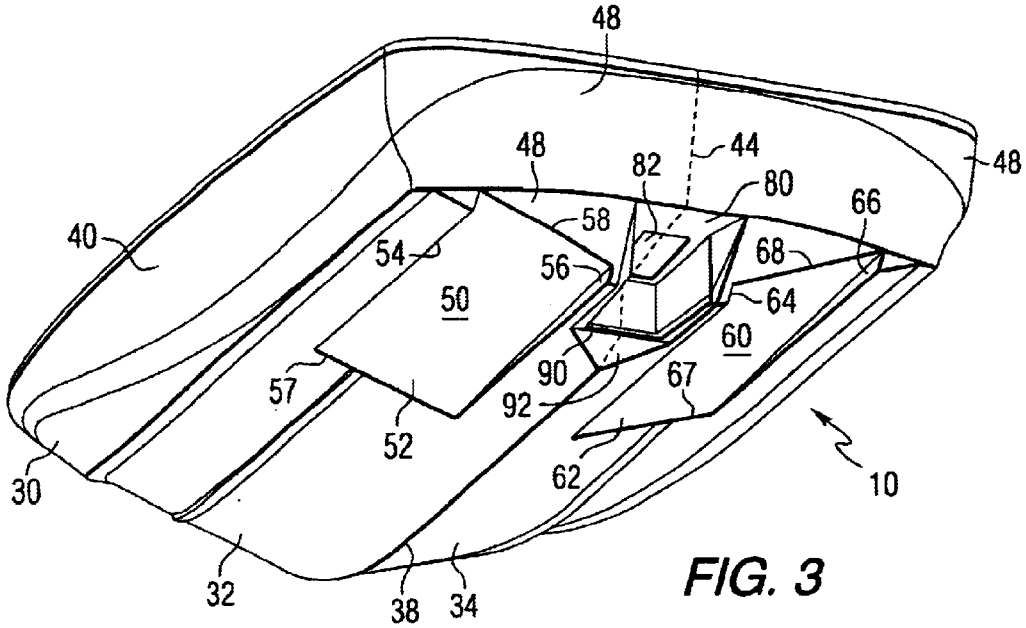
FIG. 3 is an isometric bottom view of a boat made according to the present invention.

FIG. 3 shows a boat 10 having a hull 30 which has a port surface 32 and a starboard surface 34. For purposes of this description, the port surface 32 shall be considered to extend from the keel line 38 to, and including, the free board 40 on the port side of the boat 10. Similarly, the starboard surface 34 extends from the keel line 38 to, and including, the free board on the starboard side of the boat 10.

Figure 4:
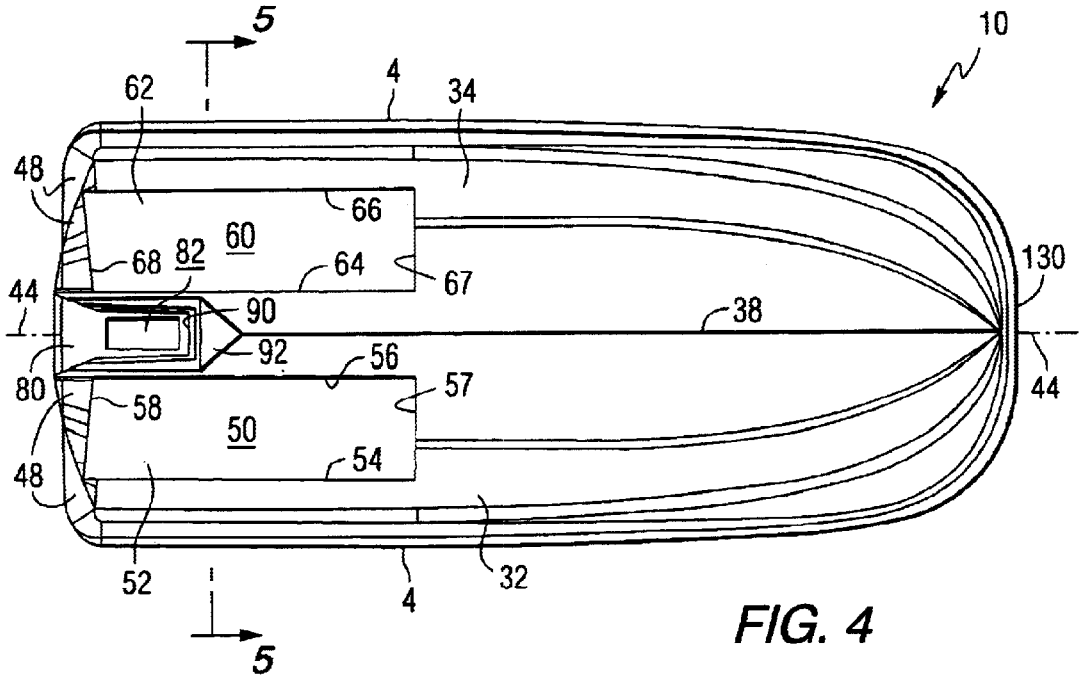
FIG. 4 is a bottom view of the boat shown in FIG. 3.

FIG. 4 is a bottom view of the boat 10. With reference to FIGS. 3 and 4, the present invention provides a first channel 50 which has a first generally planar surface 52. The first generally planar surface 52 is contiguous with two sidewalls. A first sidewall 54 is disposed on a port side of the first channel 50 and a second sidewall 56 is disposed on a starboard side of the first channel 50. The first generally planar surface 52 intersects the port surface 32 at forward edge 57 and at an angle to define a continuous surface with a second portion of the hull which is forward of the second generally planar surface 52. The generally planar surface 52 intersects the transom 48 at a rearward edge 58. A second channel 60 is formed in the starboard surface 34 and has a second generally planar surface 62. The second generally planar surface 62 is contiguous with a pair of sidewalls. A third sidewall 64 is disposed on a port side of the second channel 60 and a fourth sidewall 66 is disposed on a starboard side of the second channel 60. The second generally planar surface 60 intersects the starboard surface 34 of the hull at a forward edge 67 and at an angle to define a continuous surface with a second portion of the starboard surface 34 which is forward of the second generally planar surface 62. A rearward edge 68 of the planar surface 62 intersects the transom 48. For purposes of this description of the present invention, the transom shall be interpreted as meaning the rearward surface of the boat 10 which remains unwetted when the boat is in a planing position.

With continued reference to FIGS. 3 and 4, it can be seen that the boat 10 is provided with a cavity 80 that is shaped to receive a jet pump propulsion system 16 such as that described above in conjunction with FIG. 2. An opening 82 is provided to allow a driveshaft of an engine, which is typically located within the boat 10, to extend downwardly and be connected in torque transmitting relation with an impeller shaft of a jet propulsion system 16. For purposes of clarity, the jet pump propulsion system 16 is not shown in FIGS. 3 and 4. However, the operation of jet pump propulsion systems is well known to those skilled in the art. Jet pump propulsion systems 16 receive a flow of water through an inlet 18 disposed at a bottom surface of the boat 10, accelerate the flow of water by an impeller, and expel the accelerated stream of water through a nozzle 20 to create a thrust in the opposite direction on the boat.

Figure 5:
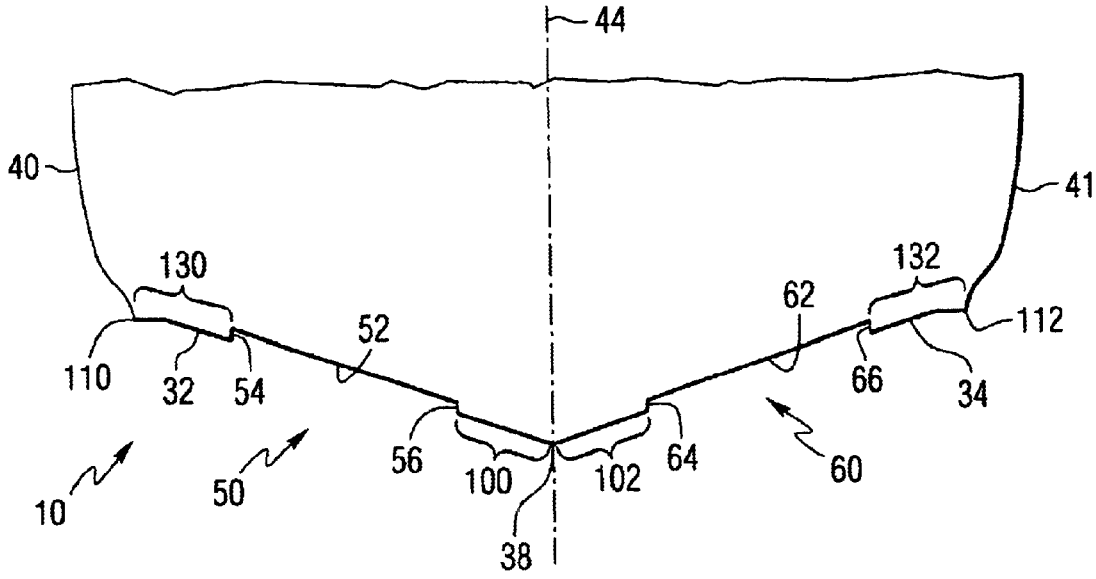
FIG. 5 is a silhouette of a section view taken through the illustration of FIG. 4.

FIG. 5 is a silhouette of a section taken through the boat 10 at a point through the front edge 90 of the cavity 82 which is shaped to receive the jet pump propulsion system 16. The section is also taken at the rearward edge of the "delta pad" 92, shown in FIGS. 3 and 4. In the silhouette view of FIG. 5, the first and second planar surfaces, 52 and 62, are shown with their contiguous sidewalls. As can be seen in FIG. 5, the first and second sidewalls, 54 and 56, are generally parallel to the central vertical plane 44. Also, the third and fourth sidewalls, 64 and 66, are generally parallel to the central vertical plane 44. With reference to FIGS. 3–5, it can also be seen that each pair of sidewalls comprises two generally parallel sidewalls. The first and second sidewalls, 54 and 56, are generally parallel to each other. The third and fourth sidewalls, 64 and 66, are also generally parallel to each other.

The first and second channels, 50 and 60, are displaced from the central vertical plane 54. More specifically, a portion 100 of the port surface 32 is located between the second sidewall 56 and the keel line 38 which is within the central vertical plane 44. Also, a portion 102 of the starboard surface 34 is disposed between the third sidewall 54 and the keel line 38.

With continued reference to FIG. 5, the port surface, between the port chine 110 and the keel line 38, is typically considered the wetted surface when the boat 10 is operating on plane. The width of the first channel 50 is greater than half of the distance between the central vertical plane 44, at the keel line 38, and the port chine 110. This width measurement is taken along the port surface 32 between the keel line 38 and the port chine 110 in a direction generally perpendicular to the line of connection between the first planar surface 52 and its associated pair of sidewalls, 54 and 56. Similarly, the width of the second channel 60 is greater than half of the length between the central vertical plane 44 and the starboard chine 112. In other words, the widths of the channels are more than half of the width of the total wetted surface of the hull in a particularly preferred embodiment of the present invention.

Figure 6:
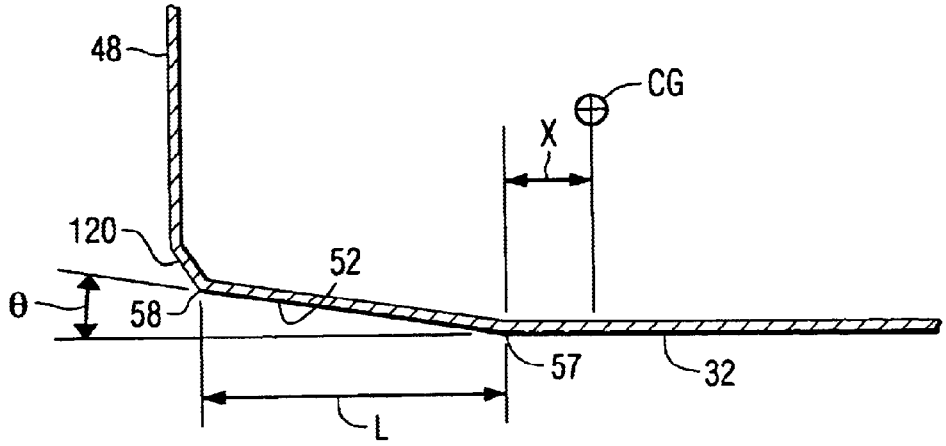
FIG. 6 is section view of one of the pair of channels formed in the hull of the boat according to a preferred embodiment of the present invention.

FIG. 6 is a section view taken along a line which is parallel to the central vertical plane 44 and through the length of the first channel 50. The transom 48 is provided with a transition surface 120 in some applications of the present invention. The first generally planar surface 52 extends from a forward edge 57 to a rearward edge 58. At the forward edge 57, the planar surface 52 intersects the hull at an angle θ to define a continuous surface which comprises both the first generally planar surface 52 and the port surface 32. This intersection is continuous because no discontinuity, or step, occurs at the forward edge 57 of the first generally planar surface 52 of the first channel 50 or at the forward edge 67 of the second generally planar surface 62 of the second channel 60. The present invention intentionally avoids a discontinuity, such as a step, at the forward edges, 57 and 67, of the first and second generally planar surfaces, 52 and 62.

With continued reference to FIG. 6, a hypothetical center of gravity CG is shown relative to the forward edge 57 of the first channel 50. In FIG. 6, the forward edge 57 is shown displaced behind the center of gravity CG by a dimension X. The length of the first generally planar surface 52, between the forward edge 57 and the rearward edge 58, is identified by dimension L in FIG. 6. It should be understood that the magnitudes of dimensions X and L can vary significantly within the scope of the present invention, depending on the precise goals intended to be achieved. Water flowing in contact with the port surface 32 and passing over the forward edge 57, as the boat 10 moves from a standing position to planing speed, creates a low pressure region as it passes in contact with the first generally planar surface 52. This reduced pressure, in comparison with the pressure exerted by the water on the port surface 32 surrounding and ahead the first channel 50, induces a counterclockwise movement of the boat 10 about the wetted surface of the hull. This reduced pressure, and the resulting moment, helps to counteract the effect of the clockwise moment resulting from the thrust of the jet pump propulsion system 16 which is directed above the wetted surface as described above in conjunction with FIG. 2. In a particularly preferred embodiment of the present invention, angle θ is between 1 and 2 degrees. In alternative preferred embodiments, angle θ can be between 0.5 degrees and 4.0 degrees. Depending on the particular configuration of the boat and the particular position of the center of gravity CG, alternative magnitudes of angle θ can also be used.

With reference to FIGS. 2–6, it can be seen that a boat 10 made in accordance with the preferred embodiment of the present invention, comprises a hull having a port surface 32 and a starboard surface 34 which are generally symmetrical and disposed on opposite sides of a central vertical plane 44 which extends from a bow 130 to a transom 48 of the boat. A first channel 50 is formed in the port surface 32 and has a first generally planar surface 52 which is generally contiguous with a pair of sidewalls, 54 and 56. A forward edge 57 is formed where the first generally planar surface 52 intersects the hull at an angle θ to define a continuous surface. A rearward edge 58 is where the first generally planar surface intersects the transom 48. A second channel 60 is formed in the starboard surface 34 and has a second generally planar surface 62 which is contiguous with a pair of sidewalls, 64 and 66. The second generally planar surface intersects the hull at a forward edge 67 and at an angle θ to define a continuous surface with a second portion of the hull which is forward of the second generally planar surface 62. A rearward edge 68 of the second generally planar surface intersects the transom 48.

With respect to the first channel 50, a first sidewall 54 is disposed on a port side of the first channel 50 and a second sidewall 56 is disposed on a starboard side of the first channel 50. With respect to the second channel 60, a third sidewall 64 is disposed on a port side of the second channel 60 and a fourth sidewall 66 is disposed on a starboard side of the second channel 60. The first pair of sidewalls, 54 and 56, are parallel to each other and the second pair of sidewalls, 64 and 66, are parallel to each other. A jet pump 16, which is disposed within cavity 80, is attached to the boat and positioned to expel water in a rearward direction to exert a thrust on the boat in a forward direction. The thrust is exerted along a line which is above at least a portion of the wetted surface of the hull. The first and second channels, 50 and 60, are each displaced from the central vertical plane 44, with portions of the hull, 100 and 102, respectively, between the first and second channels and a keel line 38 which lies within the central vertical plane 44. The angle θ which lies between the port and starboard surfaces, 32 and 34, and their associated first and second generally planar surfaces, 52 and 62, respectively, is between 0.5 degrees and 4.0 degrees in a preferred embodiment of the present invention. The width of the first channel is greater than half of the length between the central vertical plane and a port chine of the hull and the width of the second channel 60 is greater than half the length between the central vertical plane 44 and a starboard chine 112 of the hull. In alternative embodiments, the forward edge 57 of the first channel 50 is disposed between the transom 48 and the center of gravity CG of the boat and the forward edge 67 of the second channel 60 is disposed between the transom 48 and the center of gravity CG of the boat. Alternatively, the center of gravity CG of the boat can be disposed between the forward edge 57 of the first channel 50 and the transom 48 and the center of gravity CG of the boat can be disposed between the forward edge 67 of the second channel 60 and the transom 48. The first channel 50 is displaced from the port chine 110, by a region 130 and the second channel 60 is displaced from the starboard chine 112 by a region 132, in a particularly preferred embodiment of the present invention. The port and starboard surfaces, 32 and 34, intersect to form the hull in a V-shape and intersect with each other along a keel line 38 which is within the central vertical plane 44.

In addition to the benefit of raising the hull of the boat, the channels provide an additional benefit of enhanced steering and handling capability. The existence of the four sidewalls, 54, 56, 64, and 66, provide steering surfaces that allow a more directionally stable response of the boat to steering commands. In a jet pump propulsion system, with no significant structure extending downwardly behind the transom to act as a rudder, steering can be difficult, particularly in sharp turns with decreased radii. The existence of the sidewalls, on each side of each channel, 50 and 60, alleviate these problems and improve handling of the boat.

Jet propelled watercraft are prone to have increased hull drag and negative handling characteristics, typically, when compared to propeller driven watercraft. The increased drag and negative handling characteristics result because of less than optimal running trim angles that are typically experienced in jet propelled watercraft. These types of boats also frequently exhibit poor directional stability. The present invention provides a design that compensates for these inherent difficulties by providing a greater trim angle than is typical in jet propelled watercraft and also improving the handling characteristics because of the provision of the sidewalls at the sides of each of the channels, 50 and 60. The present invention enhances bow lift by increasing the hull trim angle through the redistribution of lifting forces. This is done through the careful provision of a beneficial pressure distribution on the bottom of the boat with the use of the first and second generally planar surfaces, 52 and 62, of the first and second channels, 50 and 60. The nearly vertical surfaces of the two pairs of sidewalls also improves directional stability as the boat reaches planing speed. The angle $\theta$ is selected to prevent ventilation or flow separation from the hull surfaces as the water passes over the forward edges, 57 and 67, of the first and second channels. It has been determined that an angle $\theta$ between 0.5 degrees and approximately 4 degrees satisfies this requirement.

In a particularly preferred embodiment of the present invention, the total length of the boat is approximately 18 feet, the length of each channel between the forward edge and the rearward edge is approximately 6.26 feet and angle $\theta$ is approximately 1.6 degrees.

Although the present invention has been described with particular detail and illustrated to show a preferred embodiment, it should be understood that alternative embodiments are also within its scope.

We claim:

1. A boat, comprising:

a hull having a port surface and a starboard surface, said port and starboard surfaces being generally symmetrical and disposed on opposite sides of a central vertical plane which extends from a bow of said boat to a transom of said boat;

a first channel formed in said port surface, said first channel having a first generally planar surface and a side wall which is contiguous with said first generally planar surface, a first forward edge of said first generally planar surface intersecting said hull at an angle to define a continuous surface with a first portion of said hull which is forward of said first generally planar surface, a first rearward edge of said first generally planar surface intersecting said transom; and a second channel formed in said starboard surface, said second channel having a second generally planar surface and a side wall which is contiguous with said second generally planar surface, a second forward edge of said second generally planar surface intersecting said hull at an angle to define a continuous surface with a second portion of said hull which is forward of said second generally planar surface, a second rearward edge of said second generally planar surface intersecting said transom.

2. The boat of claim 1, wherein:

said side wall which is contiguous with the first generally planar surface is generally parallel to said central vertical plane; and said side wall which is contiguous with the second generally planar surface is generally parallel to said central vertical plane.

3. The boat of claim 1, wherein:

said first channel has a first pair of side walls, a first side wall being disposed on a port side of said first channel and a second side wall being disposed on a starboard side of said first channel; and said second channel has a second pair of side walls, a third side wall being disposed on a port side of said second channel and a fourth side wall being disposed on a starboard side of said second channel.

4. The boat of claim 3, wherein:

said first pair of side walls are parallel to each other: and said second pair of side walls are parallel to each other.

5. The boat of claim 1, further comprising:

a jet pump attached to said boat and positioned to expel water in a rearward direction to exert a thrust on said boat in a forward direction, said thrust being exerted along a line which is above at least a portion of said hull.

6. The boat of claim 1, wherein:

said first and second channels are displaced from said central vertical plane.

7. The boat of claim 1, wherein:

said angle is within the range of 0.5 degrees to 4.0 degrees.

8. The boat of claim 1, wherein:

the width of said first channel is greater than half of the length between said central vertical plane and a port chine of said hull; and the width of said second channel is greater than half of the length between said central vertical plane and a starboard chine of said hull.

9. The boat of claim 1, wherein:

said forward edge of said first channel is disposed between said transom and a center of gravity of said boat; and said forward edge of said second channel is disposed between said transom and said center of gravity of said boat.

10. The boat of claim 1, wherein:

a center of gravity of said boat is disposed between said forward edge of said first channel and said transom; and said center of gravity of said boat is disposed between said forward edge of said second channel and said transom.

11. The boat of claim 1, wherein:

said first channel is displaced from a port chine of said boat; and said second channel is displaced from a starboard chine of said boat.

12. The boat of claim 1, wherein:

said port and starboard surfaces intersect to form said hull in a V-shape.

13. The boat of claim 1, wherein:

said port and starboard surfaces intersect along a keel line which is within said central vertical plane.

14. A boat, comprising:

a hull having a port surface and a starboard surface, said port and starboard surfaces being generally symmetrical and disposed on opposite sides of a central vertical plane which extends from a bow of said boat to a transom of said boat, said port and starboard surfaces intersecting along a keel line which is within said central vertical plane to form said hull in a V-shape;

a first channel formed in said port surface, said first channel having a first generally planar surface and a first pair of side walls which are contiguous with said first generally planar surface, a forward edge of said generally planar surface intersecting said hull at an angle to define a continuous surface with a first portion of said hull which is forward of said first generally planar surface, a rearward edge of said planar surface intersecting said transom; and a second channel formed in said starboard surface, said second channel having a second generally planar surface and a second pair of side walls which are contiguous with said second generally planar surface, a forward edge of said generally planar surface intersecting said hull at an angle to define a continuous surface with a second portion of said hull which is forward of said second generally planar surface, a rearward edge of said planar surface intersecting said transom.

15. The boat of claim 14, wherein:

both of said first pair of side walls are generally parallel to said central vertical plane; and both of said second pair of side walls are generally parallel to said central vertical plane.

16. The boat of claim 15, further comprising:

a jet pump attached to said boat and positioned to expel water in a rearward direction to exert a thrust on said boat in a forward direction, said thrust being exerted along a line which is above at least a portion of said hull.

17. The boat of claim 16, wherein:

said first and second channels are each displaced from said central vertical plane, said angle is within the range of 0.5 degrees to 4.0 degrees, the width of said first channel is greater than half of the length between said central vertical plane and a port chine of said hull, and the width of said second channel is greater than half of the length between said central vertical plane and a starboard chine of said hull.

18. The boat of claim 14, wherein:

said forward edge of said first channel is disposed between said transom and a center of gravity of said boat; and said forward edge of said second channel is disposed between said transom and said center of gravity of said boat.

19. A boat, comprising:

a hull having a port surface and a starboard surface, said port and starboard surfaces being generally symmetrical and disposed on opposite sides of a central vertical plane which extends from a bow of said boat to a transom of said boat, said port and starboard surfaces intersecting along a keel line which is within said central vertical plane to form said hull in a V-shape;

a first channel formed in said port surface, said first channel having a first generally planar surface and a first pair of side walls which are contiguous with said first generally planar surface, a forward edge of said generally planar surface intersecting said hull at an angle to define a continuous surface with a first portion of said hull which is forward of said first generally planar surface, a rearward edge of said planar surface intersecting said transom;

a second channel formed in said starboard surface, said second channel having a second generally planar surface and a second pair of side walls which are contiguous with said second generally planar surface, a forward edge of said generally planar surface intersecting said hull at an angle to define a continuous surface with a second portion of said hull which is forward of said second generally planar surface, a rearward edge of said planar surface intersecting said transom, said first and second channels each being displaced from said central vertical plane, the width of said first channel is greater than half of the length between said central vertical plane and a port chine of said hull, and the width of said second channel is greater than half of the length between said central vertical plane and a starboard chine of said hull, said first channel being displaced from a port chine of said boat, said second channel being displaced from a starboard chine of said boat, said port and starboard surfaces intersecting along a keel line which is within said central vertical plane; and a jet pump attached to said boat and positioned to expel water in a rearward direction to exert a thrust on said boat in a forward direction, said thrust being exerted along a line which is above at least a portion of said hull.

20. The boat of claim 19, wherein:

said forward edge of said first channel is disposed between said transom and a center of gravity of said boat; and said forward edge of said second channel is disposed between said transom and said center of gravity of said boat.

* * * * *